US007231882B2

(12) United States Patent
Zander

(10) Patent No.: US 7,231,882 B2
(45) Date of Patent: Jun. 19, 2007

(54) SUPPORT ASSEMBLY FOR LOADING AND SECURING A TENDER

(75) Inventor: Rudy Zander, Cambridge (CA)

(73) Assignee: Anchor Welding Inc., Cambridge, ON (CA)

( * ) Notice: Subject to any disclaimer, the term of this patent is extended or adjusted under 35 U.S.C. 154(b) by 72 days.

(21) Appl. No.: 11/148,214

(22) Filed: Jun. 9, 2005

(65) Prior Publication Data

US 2006/0118026 A1 Jun. 8, 2006

(51) Int. Cl.
*B63B 35/40* (2006.01)

(52) U.S. Cl. ..... 114/259; 114/365

(58) Field of Classification Search ..... 114/259, 114/365

See application file for complete search history.

(56) References Cited

U.S. PATENT DOCUMENTS 4,834,016 A 5/1989 Brown
4,964,358 A 10/1990 Sandrow
4,997,332 A * 3/1991 Johnson ..... 414/534
5,133,275 A 7/1992 Maurizio
5,522,341 A 6/1996 Green
5,636,587 A 6/1997 Klimowicz
6,038,994 A 3/2000 Ford et al.
6,089,174 A * 7/2000 Slikkers et al. ..... 114/259
6,095,080 A 8/2000 Weber
2002/0083881 A1* 7/2002 Arias ..... 114/343
2004/0099198 A1* 5/2004 Blackmore ..... 114/259

* cited by examiner

*Primary Examiner*—Stephen Avila
(74) *Attorney, Agent, or Firm*—Miller Thomson LLP

(57) ABSTRACT

A support assembly for loading and securing a tender including first and second subassemblies. The first assembly includes a winch assembly for positioning the tender on the support assembly and the second subassembly includes a releasable securing device. Both subassemblies include a series of pivotal shafts having rollers which help guide and support the tender into position.

19 Claims, 8 Drawing Sheets

SUPPORT ASSEMBLY FOR LOADING AND SECURING A TENDER

FIELD OF THE INVENTION

This invention relates in general to devices for boats and more particularly to a device for loading and handling a tender for a watercraft.

BACKGROUND OF THE INVENTION

Most large watercraft have a tender or dingy that is some how mounted to the watercraft that is used for moving people or various items to and from the watercraft. In general the tender or dingy can come in a variety of forms. They may be inflatable, motorized and in general are light weight. Depending on the weight of the tender they may be manually secured and raised onto the watercraft or they may be secured using some form of powered lifting mechanism. As the tender or dingy can come in a wide a variety of shapes and sizes, it is difficult to address all the different requirements for lifting, loading and securing the tender with ease, namely the weight of the tender or the presence of an outboard motor by way of example only. Furthermore depending on how the tender is secured to the watercraft, rough waves can actually lift the secured tender and may tear out the supporting struts of traditional platforms on the stern of the watercraft.

Prior art devices for loading and handling a tender for a watercraft have been devised to address the noted problems. For example, U.S. Pat. No. 5,636,587 issued on Jun. 10, 1997 to Klimowicz and relates to a watercraft carrier that is secured to a large watercraft having a transom. The carrier includes a mounting structure secured to the transom and a platform structure including a pair of laterally spaced platform units extending parallel to the transom and substantially in a horizontal plane above the water line of the large watercraft. The platform units each similarly include a support bar. A plurality of rollers are secured in longitudinally spaced relation along the bar. The rollers are formed of a resilient material or resiliently loaded to conform to the bottom of the personal watercraft. The personal watercraft has an inclined bow or front end and is self-propelled causing it to move upwardly out of the water onto the platform units in a highly safe and reliable procedure. Power is applied to the personal watercraft to move the hull upwardly on the entrance end and then the power is increased to cause the watercraft to move rapidly onto and in essence pop out of the water onto the platform units. The weight of the watercraft provides a firm support of the personal watercraft on the platform structure. Auxiliary securement lines may be interconnected between the personal watercraft and the larger watercraft.

Brown is the owner of U.S. Pat. No. 4,834,016 which issued on May 30, 1989 and this patent relates to a life raft deployment apparatus comprising a frame, a platform, and a life raft container receptacle. The platform is positioned within the frame and is movable between a life raft retention position and a life raft deployment position. The life raft receptacle receives containers of life rafts. The frame includes a first guide member and a second guide member which extend for the length of travel of the platform. The first guide member and the second guide member are parallel to each other. The frame further includes a stop at the ends of the travel of the platform. The platform includes a first angle member, a second angle member, and a plate extending between the angle members. The platform is mounted on a plurality of rollers. Lock members are included within the frame and the platform so as to fixedly maintain the platform in either the life raft retention position or the life raft deployment position.

Thus a device that handles, loads and secures a tender with ease, does not require the removal of the outboard motor, and is secured with is releasing assembly so as to avoid damage to watercraft is desirable.

SUMMARY OF THE INVENTION

An object of one aspect of the present invention is to provide an improved support assembly for loading and securing a tender as set out in the embodiments outlined below.

The problems discussed above have been overcome by a support assembly for loading and securing a tender. The support assembly may be mounted to traditional swim platforms already installed onto watercraft so that the current invention does not require additional structure to be mounted to the watercraft. The support assembly may include a roller assembly having a first sub-assembly and a second sub-assembly mounted apart from one another thereby leaving the centre of swim platform unobstructed and allowing the swim platform to be used for other uses once the tender is launched.

Both subassemblies may allow for the natural positioning of the tender on the support assembly. The positioning of the tender on the subassemblies does not require the outboard motor, the fuel tank or life jackets to be removed making it easy and faster to load the tender to the watercraft. Furthermore the configuration of the subassemblies may allow for the easy loading with the aid of a winching assembly.

The support assembly may also include a releasable securing means that may secure the tender to the watercraft. The structure of the releasable securing means allows the tender to be secured to both of the sub-assemblies yet releases should rough waves hit the watercraft and the tender, thereby protecting the structure of the swim platform and the watercraft itself.

BRIEF DESCRIPTION OF THE DRAWINGS

A detailed description of the preferred embodiments is provided herein below by way of example only and with reference to the following drawings, in which.

Figure 1:
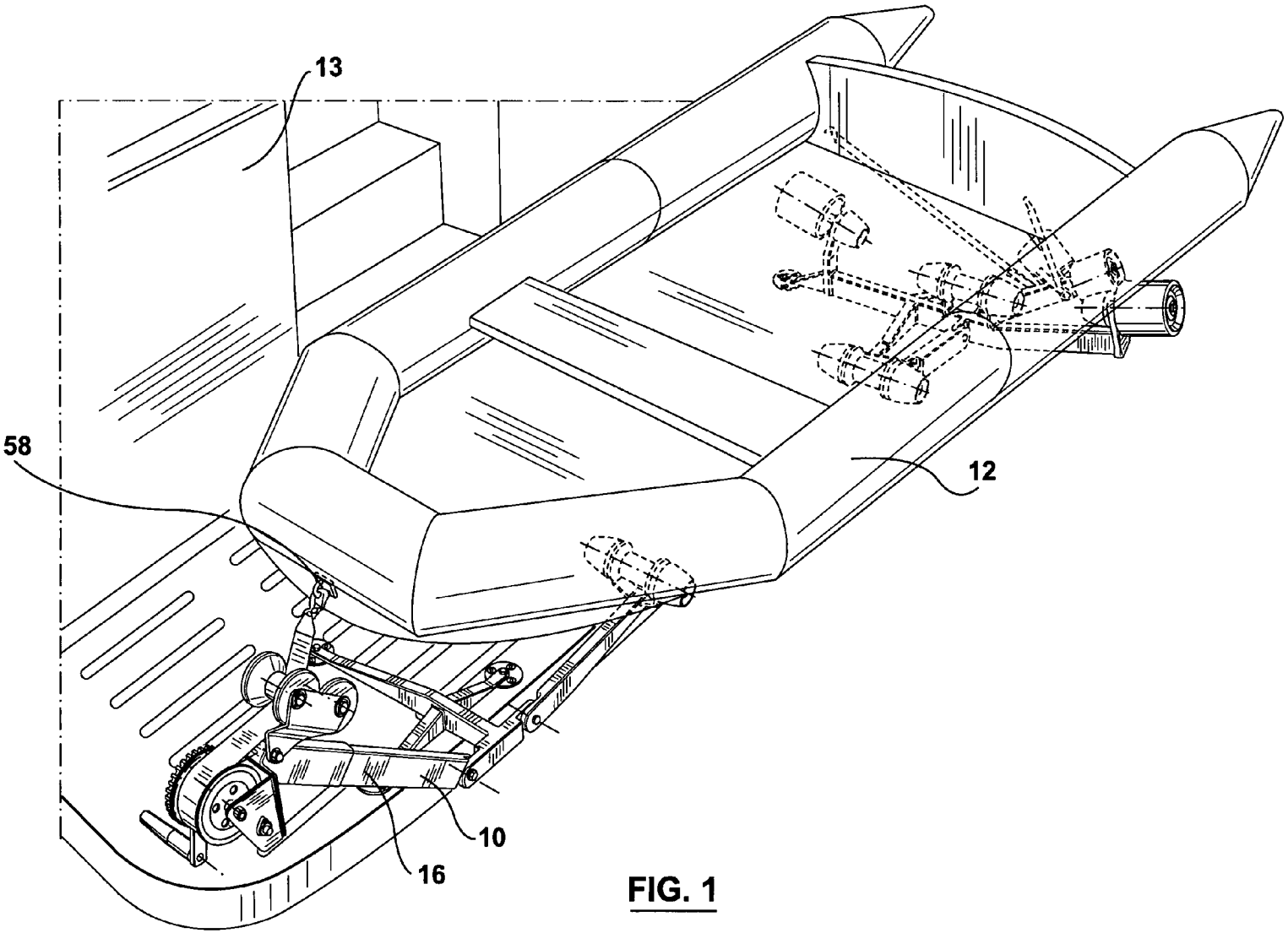
FIG. 1 in a perspective view, illustrates a support assembly for loading and securing a tender in accordance with a preferred embodiment of the present invention.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Figure 2:
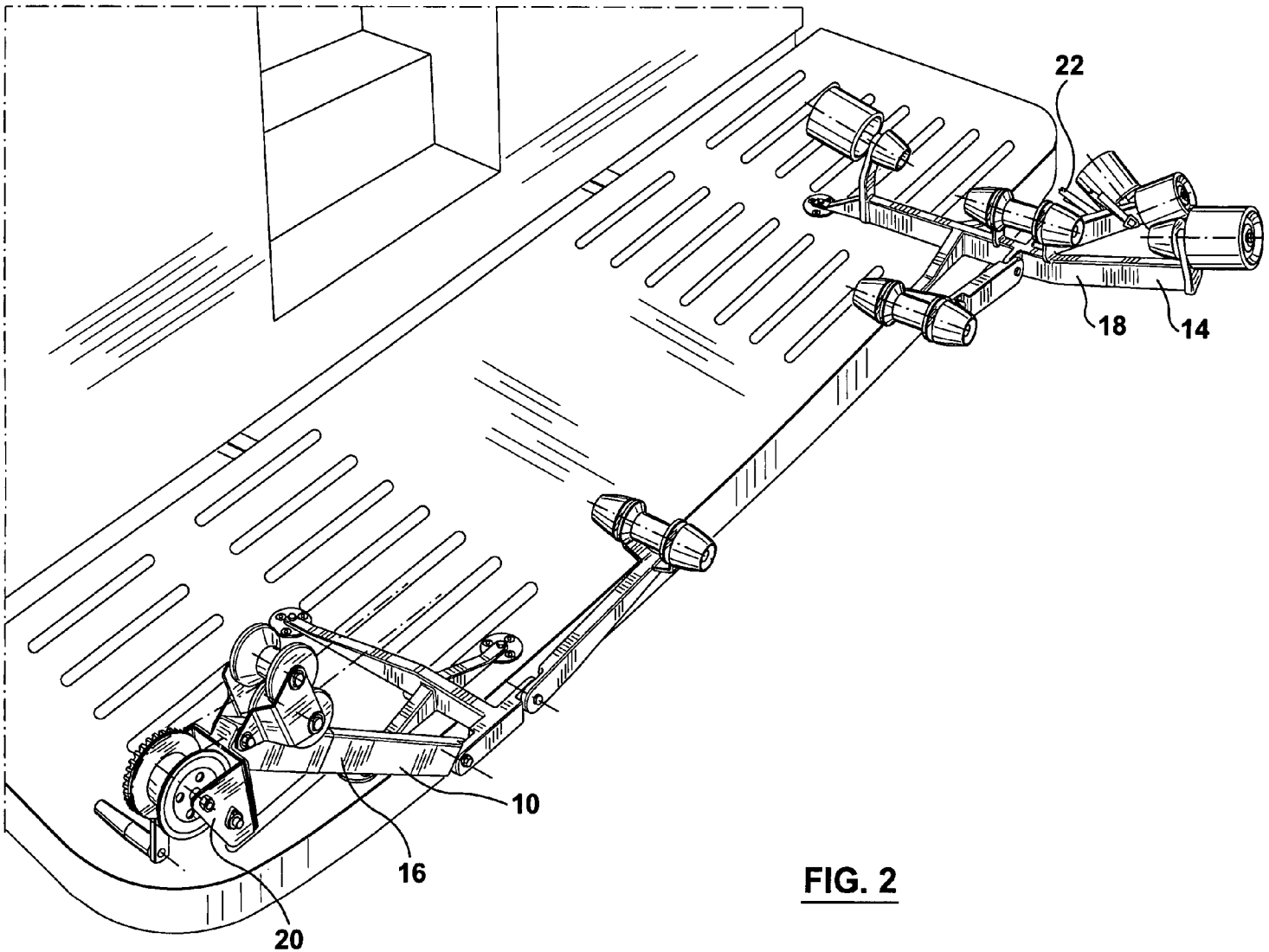
FIG. 2 in a perspective view, illustrates the support assembly of FIG. 1 mounted to a swim platform.
Figure 3:
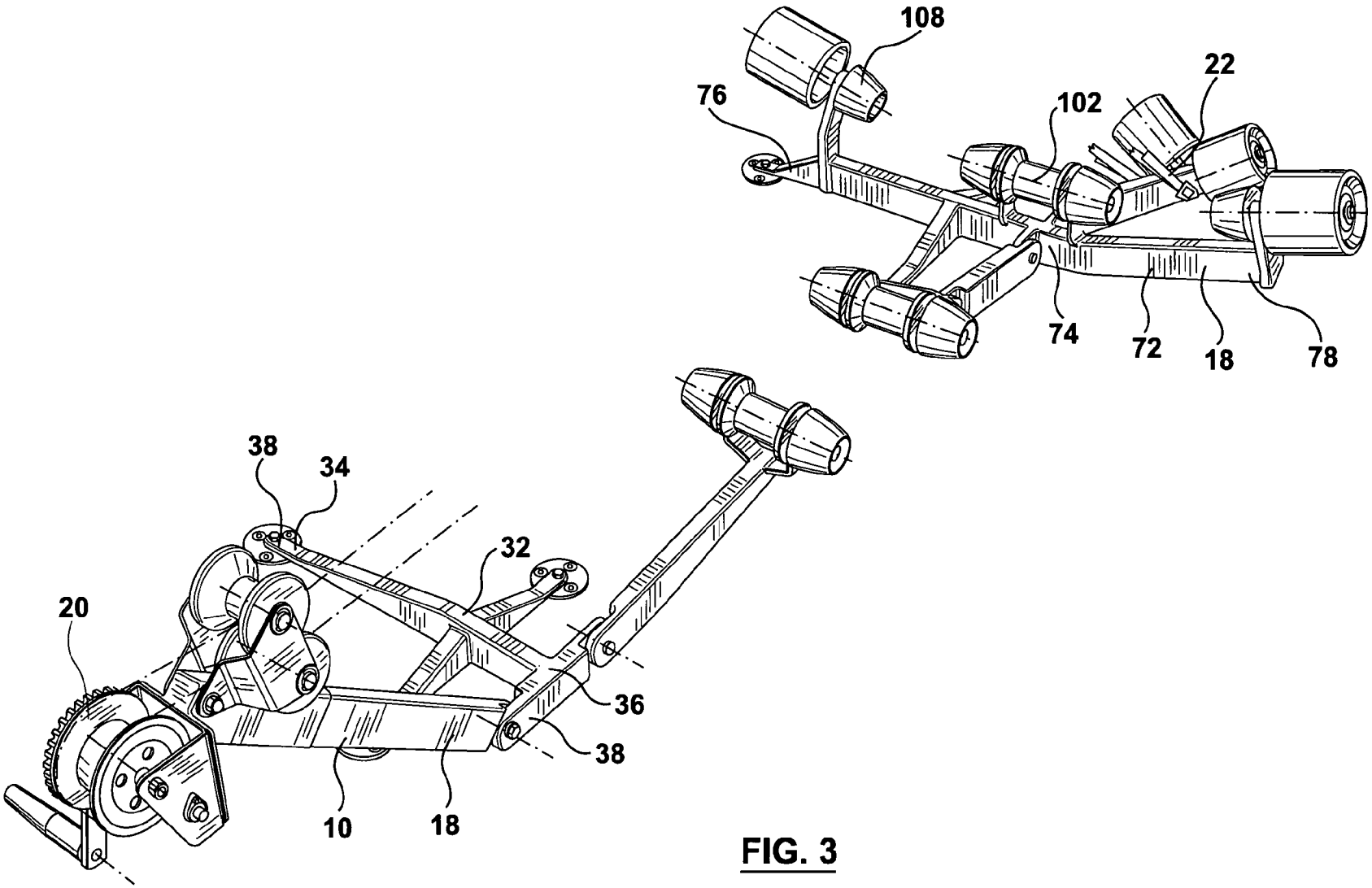
FIG. 3 in a perspective view, illustrates the support assembly of FIG. 1.

Referring to FIGS. 1 to 3, there is illustrated in a perspective view, a support assembly 10 for loading and securing a tender 12 to a watercraft 13 in accordance with a preferred embodiment of the present invention. The support assembly 10 for loading and securing a tender 12 includes a roller assembly 14 having a first subassembly 16 and a second subassembly 18. The first assembly 16 may further comprise of a positioning means 20 for positioning the tender 12 on the support assembly 10. The second subassembly 18 may further comprise of a releasable securing means 22 that secures the tender 12 to the support assembly 10.

Figure 4A:
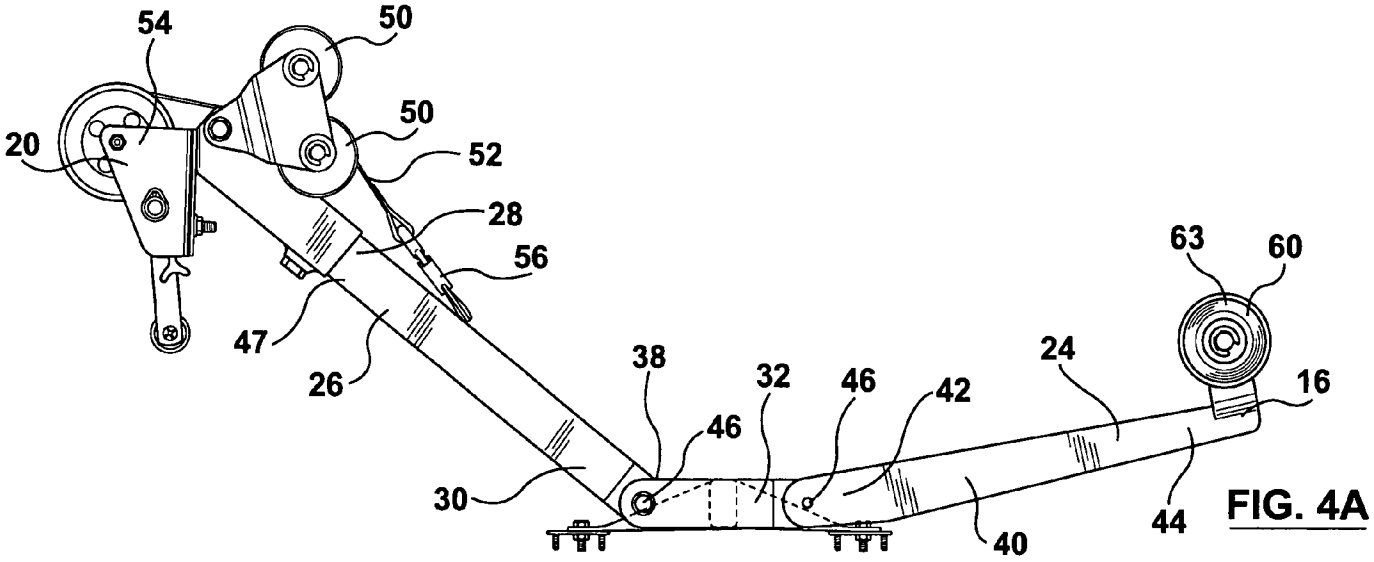
FIG. 4*a* in a side view, illustrates a first subassembly of the support assembly.

Referring to FIGS. 3 and 4*a* the first assembly 16 may include a series of shafts 24 operatively connected to one another. More specifically a first shaft 26 having a first end 28 and a second end 30, may have mounted to the first end 28 the positioning means 20. A second shaft 32 may have a plurality of attachment zones 38 so that the second end 30 of the first shaft 26 is mounted to one of these attachment zones 38. The second shaft 32 may have a first end 34 and a second end 36. The first end 34 may be secured to the watercraft 13 at one of the attachment zones 38. The second end 36 may have the second end 30 of the first shaft 26 mounted at one of the attachment zones 38. A third shaft 40 may have first end 42 and second end 44 wherein the first end 42 of the third shaft 40 is mounted to an attachment zone 38 of the second end 36 of the second shaft 32.

The series of shafts 24 may be operatively connected to one another via pivotal connections 46, specifically a ratchet pivot motion. More specifically the attachment of the second end 30 of the first shaft 26 to the attachment zone 38 of the second shaft 32 allows for a 180 degree pivot. The attachment of the first end 42 of the third shaft 40 to the attachment zone 38 of the second shaft 32 also allows for a 180 pivot. The ability of the first shaft 26 and the third shaft 40 to pivot about the second shaft 32 allows the support assembly 10 and more specifically the first subassembly 16 to adjust to accommodate different sized tenders 12.

The first end 28 of the first shaft 26 may be further defined as having a telescopic end 47 to which the positioning means 20 is mounted. The positioning means 20 may be further defined as a winch assembly 48. For example the winch assembly 48 may include a series of rollers 50, a winch belt 52 and crank assembly 54 that may be manual or motorized. The winch belt 52 may be attached to the crank assembly 54 and fed over and through the series of rollers 50. The winch belt 52 may further include an attachment mechanism or device 56 such as a hook that may be attached to the tender 12 and more specifically to an eye bolt 58 located at the bow of the tender 12. The winch assembly 48 may be adjustable and may include a swivelling action. Furthermore the height of the winch assembly 48 may be adjusted by manipulating the telescopic end 47 of the first end 28 of the first shaft 26.

The second end 44 of the third shaft 40 may further comprise at least one rolling means 60 generally located to provide support for the keel 62 of the tender 12. The rolling means may be further defined as at least one roller 63. As discussed above the third shaft 40 pivots and is therefore adjustable in an up and down direction by the pivot connection 46 and therefore can adjust for different sized tenders 12. The pivotal connections 46 may be maintained by using a ½ inch bolt and washer.

Figure 4B:
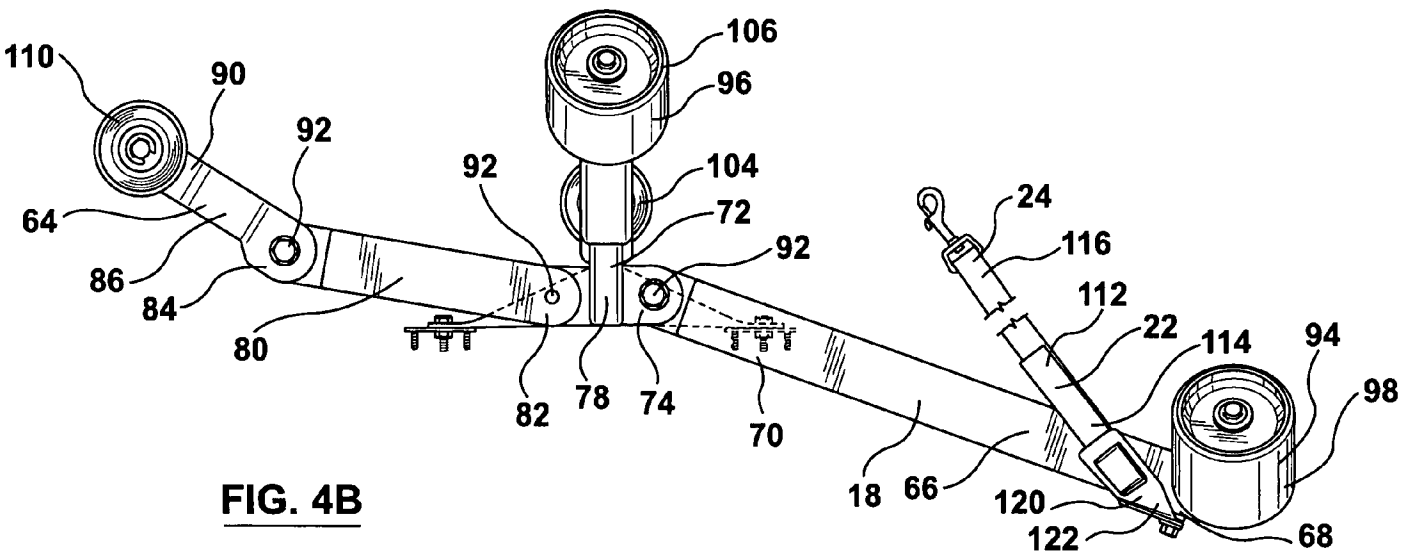
FIG. 4*b* in a side view, illustrates a second subassembly of the support assembly.

Referring to FIGS. 3 and 4*b* there is illustrated the second subassembly 18 which may include a series of shafts 64 operatively connected to one another. More specifically a first shaft 66 having a first end 68 and a second end 70, may have mounted to the first end 68 the releasable securing means 22 that secures the tender 12 to the support assembly 10. A second shaft 72 may have a plurality of attachment zones 74 so that the second end 70 of the first shaft 66 is mounted to one of these attachment zones 74. The second shaft 72 may have a first end 76 and a second end 78. The first end 76 may be secured to the watercraft 13 at one of the attachment zones 74.

A third shaft 80 may have first end 82 and second end 84 wherein the first end 82 of the third shaft 80 is mounted to an attachment zone 74 of the second shaft 72. The second end 84 of the third shaft 80 may be mounted to a fourth shaft 86 having a first end 88 and a second end 90.

The series of shafts 64 may be operatively connected to one another via pivotal connections 92. More specifically the attachment of the second end 70 of the first shaft 66 to the attachment zone 74 of the second shaft 72 allows for a 180 degree pivot. The attachment of the first end 82 of the third shaft 80 to the attachment zone 74 of the second shaft 72 also allows for a 180 pivot. The attachment of the first end 88 of the fourth shaft 86 to the second end 84 of the third shaft 84 also allows for a 180 pivot. The ability of the first shaft 66 to pivot about the second shaft 72 allows the first shaft 66 to lower in a downward direction to initially engage the tender 12 for loading. The ability of the third shaft 80 to pivot about the second shaft 72 and the fourth shaft 86 to pivot about the third shaft 80 allows the support assembly 10 and more specifically the second subassembly 18 to adjust to accommodate different sized tenders 12. The pivotal connections 92 may be maintained by using a ½ inch bolt and washer.

The second subassembly 18 may include a series of rolling means 94. Specifically the series of rolling means 94 may include a plurality of rollers 96. At least one roller 98 may be positioned at the first end 68 of the first shaft 66 which initially engages the tender 12 when loading. The rollers 98 may be oriented in a "V" position that aid in the initial contacting of the tender 12 with the second subassembly 18 and then guide the tender 12 along the support assembly 10 into a securing position. The rollers 98 may include a bumper (not shown) located between the rollers 98 which helps to avoid any damage to an outboard motor on the tender 12.

At least one roller 102 may be positioned at the attachment zone 74 where the second end 70 of the first shaft 66 is mounted to the second shaft 72. The roller 102 is positioned to help guide the tender 12 and specifically the keel 62 of the tender 12 along the support assembly 10. At least one roller 104 may be positioned at the first end 76 of the second shaft 72 and at least one roller 106 may be positioned at the second end 78 of the second shaft 72. The rollers 104 and 106 are positioned at an angle on the second shaft 72 to help support both the port and starboard sides of the tender 12. Bumpers 108 may be positioned next to the rollers 102, 104 and 106 to protect the hull of the tender 12 from being damaged or scratched by the series of shafts 64 and allow for the possibility of stowing and launching the tender 12 in adverse conditions. At least one roller 110 may be positioned at the second end 90 of the fourth shaft 86. The roller 110 helps the positioning of the keel 62 of the tender 12 during loading. The rollers 96 may be made from polyurethane and traditionally manufactured from an injection molding process. The rollers 96 may include a stainless steel bushing and run on stainless steel shafts. Typically the rollers 96 are secured in position by washers and an external retainer ring preferably ¼ inch.

The releasable securing means 22 may include a plurality of belts 112 having a first ends 114 and a second ends 116. The first ends 114 includes an attachment mechanism 118 that mounts to the first end 68 of the first shaft 66. The second ends 116 further include an attachment mechanism 120 that attach the belts 112 to both the port and starboard sides of the tender 12. The attachment mechanism 118 may further defined as a clevis 122, preferably stainless steel, mounted to the first end 68 of the first shaft 66 to which the first end 114 of the belts 112 are secured. The attachment mechanism 120 may be further defined as a slotted adjustable buckle 124 (preferably stainless steel) to which the second end 116 of the belts 112 is secured. The belts 112 are made from polyester and have been tested to release or break apart at 230 pounds destructive load test.

All materials other than the rollers 96, the winch assembly 48 and belts 112 may be made from highly polished stainless steel or mirror polish. The roller assembly 14 has been tested to carry a load of 1000 pounds. The first shaft 66 of the second assembly 18 has been tested to lift 1000 pounds. The telescopic end 46 to which the positioning means 20 has been tested to pull 1000 pounds.

In operation, the tender 12 may be loaded and secured to the support assembly 10 as illustrated to FIGS. 6*a* to 6*d*. Specifically the winch belt 52 is placed between the series of rollers 50, pulled through and the hook 56 is attached to the eye bolt 58 of the tender 12 waiting in the water. The winch assembly 48 is then activated to start the loading process. The winch assembly 48 may be operated manually or motorized and may be activated remotely.

Upon activation the tender 12 is winched forward and initially engages the rollers 98 oriented in a "V" position and guide the tender 12 along the support assembly 10 into a securing position. As the tender 12 moves across the support assembly 10, the tender 12 contacts the rollers 104 and 106 positioned on the second shaft 72 that help support both the port and starboard sides of the tender 12 and the keel 62 of the tender 12 contacts rollers 110 and 63. The tender 12 once tightly winched into place, the roller assembly may be adjusted tightly to the bow angle. The belts 112 may then be attached to the port and starboard sides of the tender 12 to secure the tender 12 in place. The release capability of the belts 112 avoids damage to the watercraft 13. Specifically a stern wave big enough to lift the full capacity of the tender 12 may tear out the supporting struts on the stern of the watercraft 13, however, in the current invention the belts 112 will release protecting the stern of the watercraft 13. In that scenario the tender 12 will still be held by the winch belt 52 and would not be lost.

Once loaded and secured the tender 12 therefore sits on the roller assembly 14 in its natural horizontal position, therefore the removal of the fuel tank, life jackets, and other necessary equipment, including the outboard motor, [if that is how the tender is propelled] is not necessary. Specifically the popular four stroke motor is twice the weight of a two stroke motors and do not tilt which makes them more difficult to remove from the tender 12. The roller assembly 14 will also carry a water-jet drive inflatable or sea-do. The roller assembly 14 with its two subassemblies 16 and 18, leaves the center of the swim platform 126 unobstructed for other uses after the tender 12 is launched. Also, moving these two subassemblies 16 and 18 further apart on wider carrying vessels will allow stowing and launching of longer tenders 12.

Both the first and second subassemblies 16 and 18 may be mounted to the watercraft 13 and more specifically the swim platform 126 at the first ends 34 and 76, of the second shafts 32 and 72 respectively. Both the first and second subassemblies 16 and 18 have the exact same bolt down configuration. This allows for the launching of the tender 12 from either port or starboard by reversing the two assemblies to suit one's needs.

Figure 5:
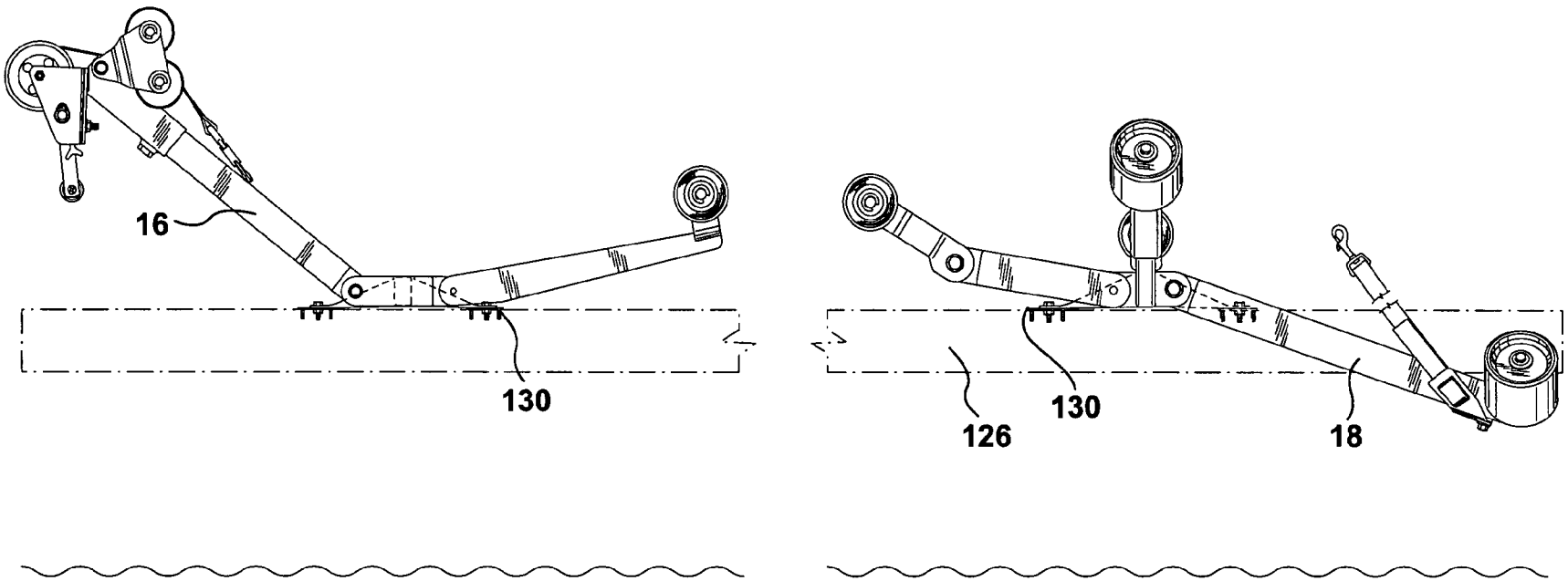
FIG. 5 in a side view, illustrates the support assembly of FIG. 1 mounted to a swim platform.
Figure 6A:
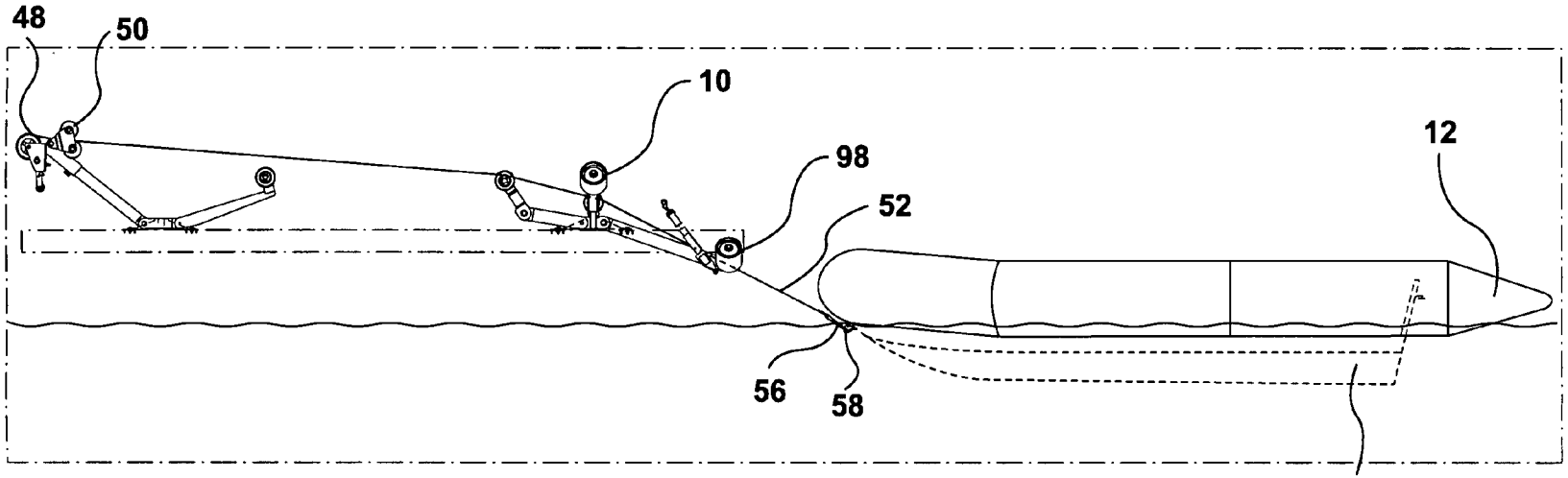
FIG. 6*a* in a side view, illustrates the support assembly of FIG. 1 mounted to a swim platform loading a tender.
Figure 6B:
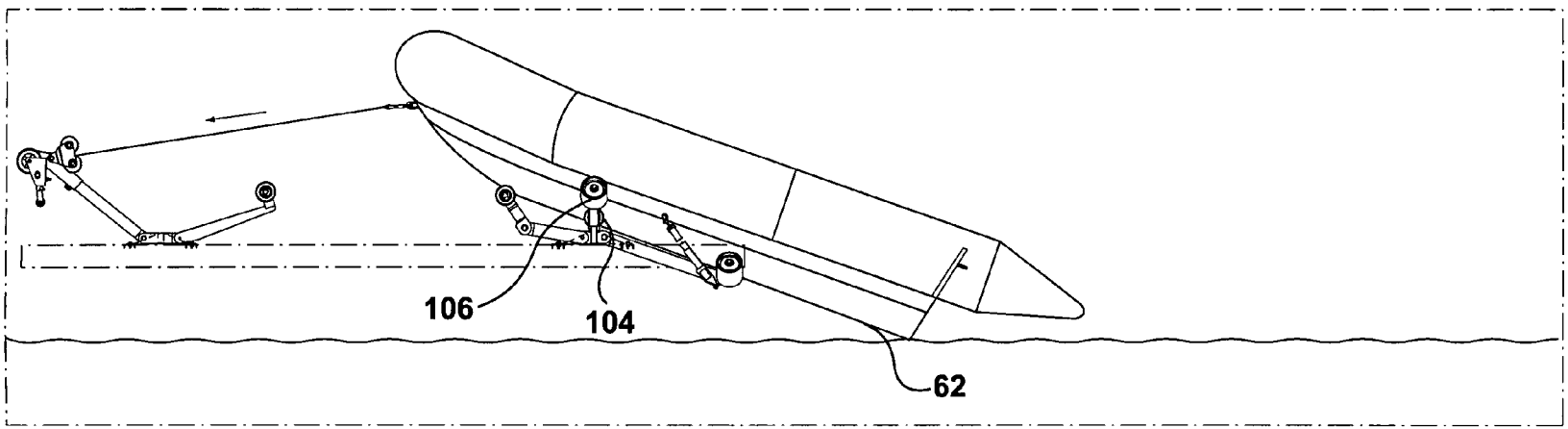
FIG. 6*b* in a side view, illustrates the support assembly of FIG. 1 mounted to a swim platform loading a tender.
Figure 6C:
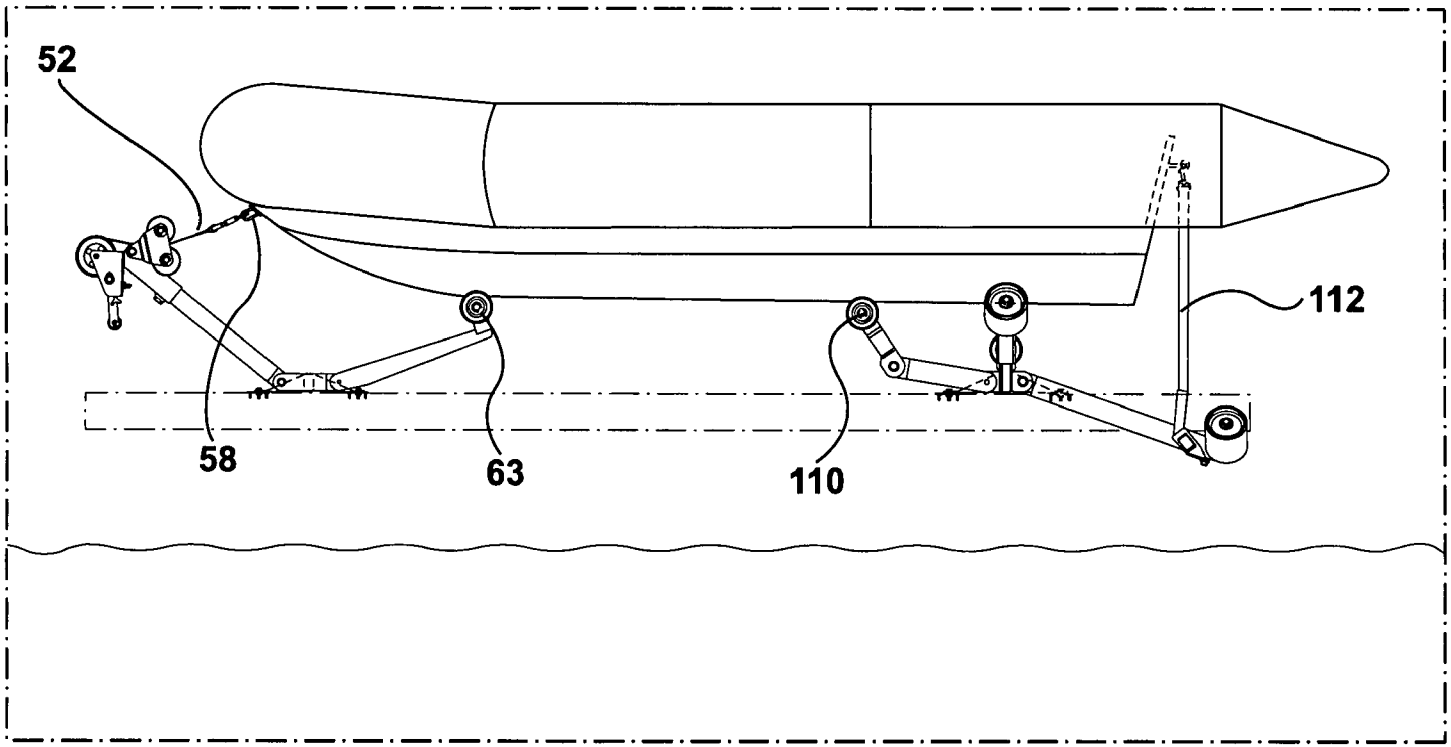
FIG. 6*c* in a side view, illustrates the support assembly of FIG. 1 mounted to a swim platform loading a tender.
Figure 6D:
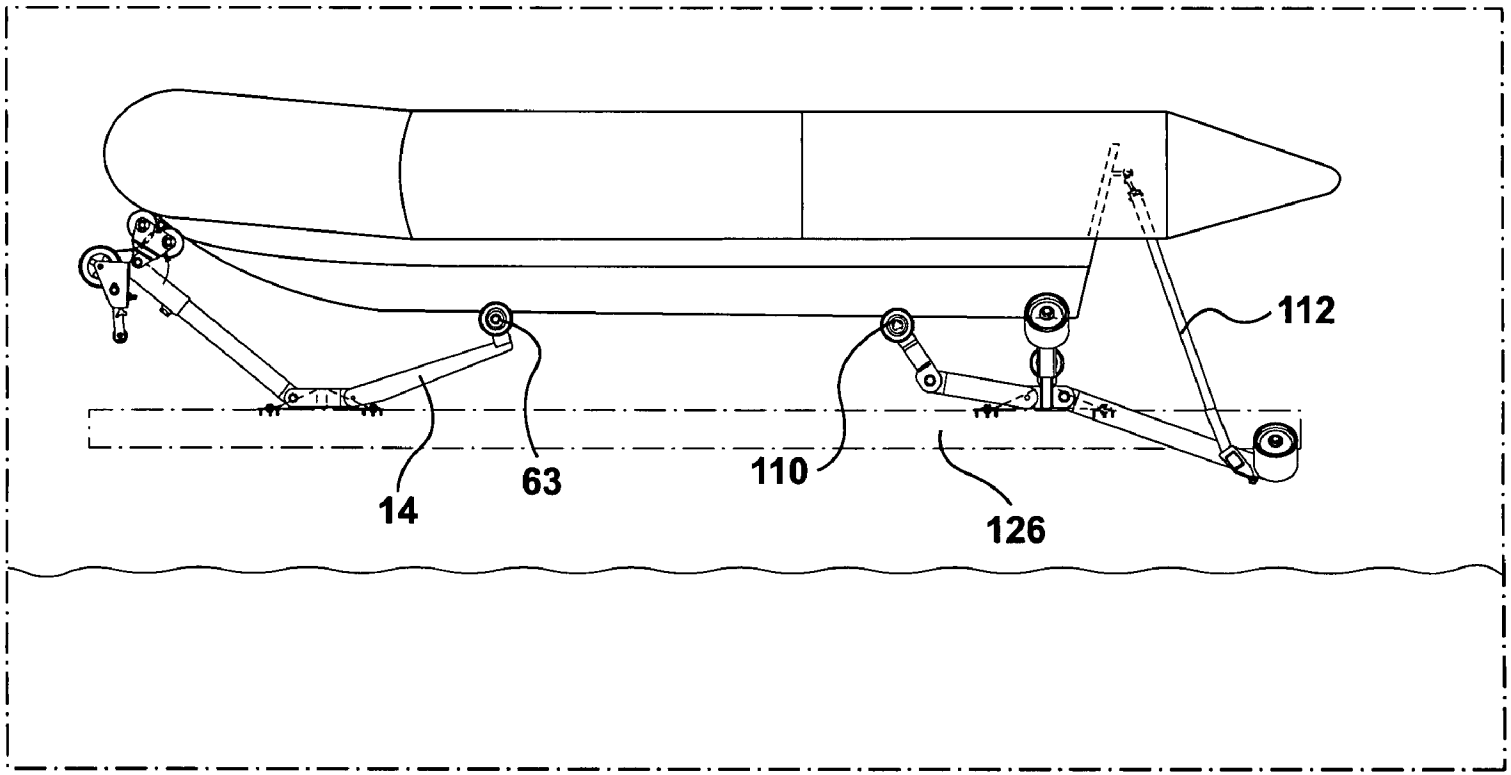
FIG. 6*d* in a side view, illustrates the support assembly of FIG. 1 mounted to a swim platform loading and securing a tender.

Referring to FIG. 5 to attach the first and second subassemblies 16 and 18 to the swim platform 126, six stainless steel hold down pads 130 having three counter sunk holes (not shown) are attached to the swim platform 126. The hold down pads 130 are positioned to have the same configuration as the first and second subassemblies 16 and 18. In the center of each pad 130 there is a sealed thread (not shown). The first and second subassemblies 16 and 18 are bolted to the pad center thread. The bolts render the support assembly 10 removable in a matter of minutes for winter storage or, for reversing for port or starboard stowing or launching of the tender 12. The six pads 130 may be permanently installed to a wood, fibreglass, metal or aluminium swim platform 126. The sealed center thread in each of the six pads 130 prevents water from seeping into the wood, or wood cored fibreglass swim platform 126.

Other variations and modifications of the invention are possible. All such modifications or variations are believed to be within the sphere and scope of the invention as defined by the claims appended hereto.

I claim:

1. A support assembly for loading and securing a tender to a watercraft comprising:

(a) a first subassembly having a first series of shafts operatively connected to one another and at least one rolling means adapted to engage the tender;

(b) a second subassembly having a second series of shafts operatively connected to one another and a series of rolling means adapted to engage the tender;

(c) a positioning means for positioning the tender on the support assembly, the positioning means mounted to the first subassembly;

(d) a releasable securing means for securing the tender to the support assembly, the releasable securing means is secured to the second subassembly wherein the first subassembly is mounted apart from the second subassembly and to the watercraft and the first series of shafts further comprises a first shaft having a first end and a second end wherein positioning means is mounted to the first end, a second shaft having a first end and a second end, and a third shaft having a first end and a second end.

2. A support assembly for loading and securing a tender as claimed in claim 1 the second shaft has a plurality of attachment zones.

3. A support assembly for loading and securing a tender as claimed in claim 1 wherein the second series of shafts are operatively connected to one another by pivotal connections.

4. A support assembly for loading and securing a tender as claimed in claim 3 wherein the pivot connections are a ratchet pivot motion.

5. A support assembly for loading and securing a tender as claimed in claim 4 wherein the pivot motion is a 180 degree pivot.

6. A support assembly for loading and securing a tender as claimed in claim 1 wherein the first end of the first shaft has a telescopic end to which the positioning means is mounted.

7. A support assembly for loading and securing a tender as claimed in claim 1 wherein the positioning means is an adjustable winch assembly.

8. A support assembly for loading and securing a tender as claimed in claim 7 wherein the winch assembly is a series of rollers, a winch belt and a crank assembly.

9. A support assembly for loading and securing a tender as claimed in claim 8 wherein the winch assembly is either manual or motorized.

10. A support assembly for loading and securing a tender as claimed in claim 1 wherein the rolling means or the first subassembly is at least one roller mounted at the second end of the third shaft.

11. A support assembly for loading and securing a tender as claimed in claim 1 wherein the second series of shafts further comprises a first shaft having a first end and a second end, wherein the releasable securing means is mounted to the first end of the first shaft, a second shaft having a first end and a second end, a third shalt having a first end and a second end, and a fourth shaft having a first end and a second end.

12. A support assembly for loading and securing a tender as claimed in claim 11 wherein the second shaft has a plurality of attachment zones.

13. A support assembly for loading and securing a tender as claimed in claim 11 wherein the series of shafts are operatively connected to one another via pivotal connections.

14. A support assembly for loading and securing a tender as claimed in claim 13 wherein the pivot connection is a ratchet pivot motion.

15. A support assembly for loading and securing a tender as claimed in claim 14 wherein the pivot motion is a 180 degree pivot.

16. A support assembly for loading and securing a tender as claimed in claim 1 wherein the series of rolling means is a plurality of rollers, wherein at least two rollers are oriented in a "V-shaped" position for initially contacting of the tender and guide the tender along the support assembly 10 into a securing position.

17. A support assembly for loading and securing a tender as claimed in claim 16 wherein at least two rollers are positioned at an angle on the second shaft to help support the tender.

18. A support assembly for loading and securing a tender as claimed in claim 1 wherein the releasable securing means is a plurality of releasable belts having a first end and a second end each having attachment mechanisms.

19. A support assembly for loading and securing a tender as claimed in claim 1 wherein the support assembly is made from stainless steel.

* * * * *